United States Patent [19]

Counihan

[11] Patent Number: 5,016,413

[45] Date of Patent: May 21, 1991

[54] RESILIENT FLOOR SYSTEM

[76] Inventor: James Counihan, 50 Griffin Mill Rd., Piedmont, S.C. 29673

[21] Appl. No.: 480,209

[22] Filed: Feb. 14, 1990

[51] Int. Cl.[5] ..... E04F 13/08

[52] U.S. Cl. ..... 52/391; 52/385; 52/403; 52/480

[58] Field of Search ..... 52/384, 385, 390, 391, 52/464, 479, 480, 762, 763, 764, 765, 770, 772, 774, 778, 779, 509, 512, 595

[56] References Cited

U.S. PATENT DOCUMENTS

| | | | |
|---|---|---|---|
| 4,170,859 | 10/1979 | Counihan | 52/391 X |
| 4,599,842 | 7/1986 | Counihan | 52/512 X |
| 4,819,932 | 4/1989 | Trotter, Jr. | 52/309.8 X |
| 4,856,250 | 8/1989 | Gronay et al. | 52/376 X |
| 4,890,434 | 1/1990 | Niese | 52/480 X |

*Primary Examiner*—Richard E. Chilcot, Jr.

*Assistant Examiner*—Creighton Smith

*Attorney, Agent, or Firm*—Cort Flint

[57] ABSTRACT

A resilient floor (A) is disclosed assembled on a base surface (10) to provide a resilient floor (36) which comprises a plurality of sub-floor sections (B) arranged generally side-by-side. A resilient layer of material (62) is carried generally co-extending underneath the sub-floor sections. A slot (38,74) and widened groove (40) accommodate a fastening member (51,71) which includes lateral flanges (58,60) and (78,80) which limit upward movement of sub-floor sections (B). Flooring strips (D) are nailed to the sub-floor sections so that the flooring strips move integrally together in relative vertical movements relative to the fastening strips (51,71). Resilient layer (62) urges sub-floor sections (B) and integral flooring strips (D) upwardly such that downward forces produced by activity on the floor (36) are provided with a degree of resiliency.

32 Claims, 2 Drawing Sheets

Fig. 1.
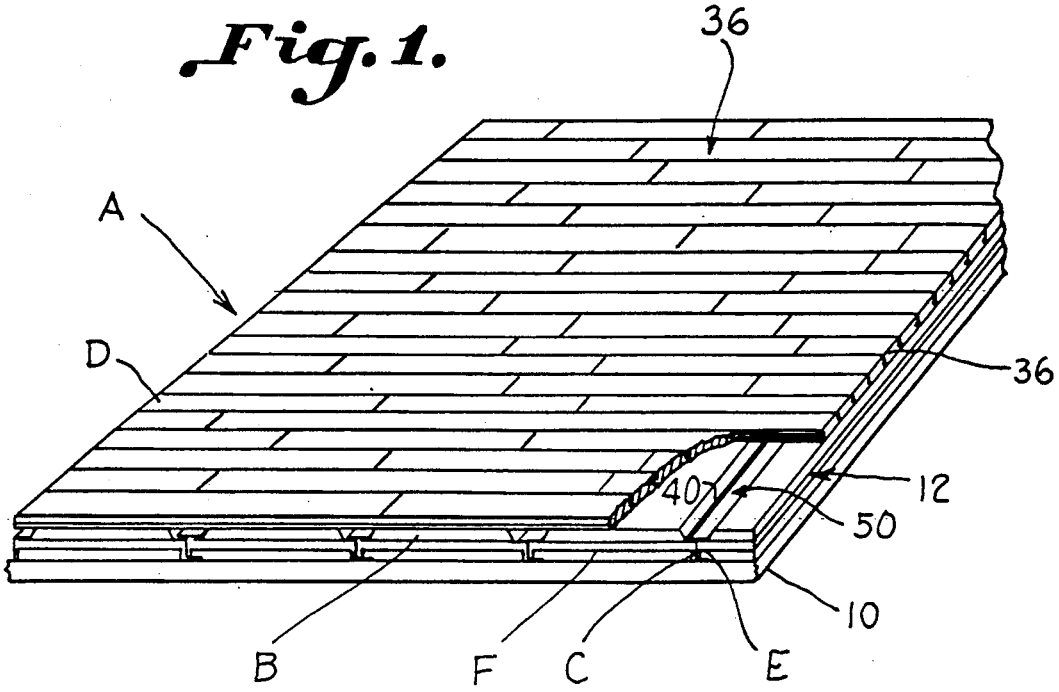
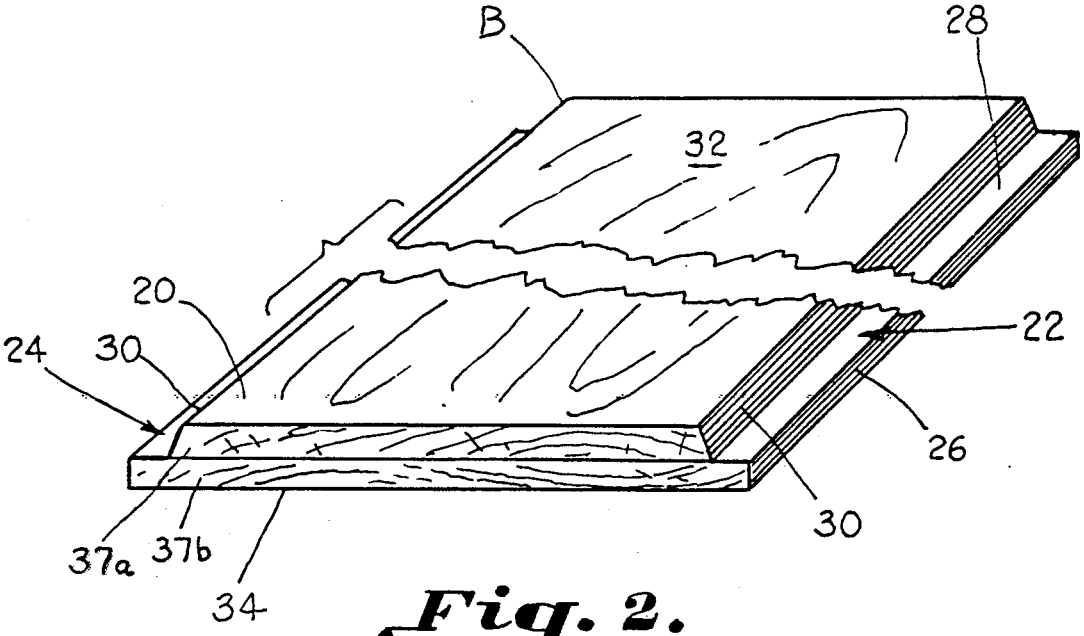
Fig. 2.

RESILIENT FLOOR SYSTEM

BACKGROUND OF THE INVENTION

The invention relates for a resilient floor system for aerobic exercise and the like.

Prior floor systems are known which provide resiliency to an exercise or athletic floor. For example, U.S. Pat. No. 4,599,842 issued to the same inventor, is directed to a fastening system which allows wood strip flooring to have some degree of resiliency. In this system, a special fastener is utilized which allows a flange strip to move over a portion of its shank so that wood flooring strips secured by the flange strip have relative movement accordingly. U.S. Pat. No. 4,819,932 is directed to an aerobic exercise floor system which utilizes resilient sub-flooring and spring clips to connect the flooring strips flexibly together. Insertion of the spring clip requires additional construction and moving parts susceptible to damage. This type of flooring system is a floating flooring system which tends to float and have dead spots. U.S. Pat. No. 4,856,250 discloses a channel member having a nailing bed to which flooring is nailed transversely. The nailing bed is constrained within a "C" shaped channel and rides on a resilient layer. The channels are nailed to the base flooring. However, only a limited amount of resilience is provided since the resilient layer is of limited size and covers a limited area underneath the flooring strips. Accordingly, an object of the invention is to provide a simple, yet effective resilient flooring system for exercise, athletics, and the like.

Another object of the invention is to provide a simple construction for a resilient floor system wherein an outer floor and a sub-floor move together in unison.

Another object of the invention is to provide a resilient floor system comprising a sub-floor and transverse flooring strips which are integrally attached yet movably secured relative to a base surface so that the flooring strips and sub-floor move unitarily together to provide a resilient floor.

SUMMARY OF THE INVENTION

A resilient flooring system for assembly on a base surface to provide a resilient floor comprises a plurality of sub-floor sections carried above the base surface to define a sub-floor. Slots are formed between adjacent sub-floor sections. A plurality of flooring strips extend transverse to the sub-floor sections to define the resilient floor. The flooring strips are attached to the sub-floor sections so that the floor and sub-floor are integral and move vertically together. Fastening strips secured to the base surface are disposed within the slots between adjacent sub-floor sections. The fastening strips about the sub-floor sections for allowing downward movement of the sub-floor sections while limiting upward movement of the sub-floor sections with the flooring strips attached. A resilient layer is carried between the base surface and the sub-floor sections biasing the sub-floor sections upwards against the fastening strip. The sub-floor sections have first and second opposing edges. The first and second edges each include an upwardly extending first side terminating at an inwardly extending abutment ledge. The abutment ledge terminates at an upwardly extending second side. The slots between adjacent sub-floor sections comprise a slot between the first sides of adjacent floor sections and a widened groove between second sides of adjacent flooring sections widened relative to the slot. The fastening strips include lateral flanges disposed within the widened groove and which abut the abutment ledge. The fastening strips may include an elongated fastening strip having a vertical stem carried in the slot, and first and second lateral flanges extending in opposite directions carried by the vertical stem in the widened groove. The widened groove tapers outwardly to reduce binding of the lateral flange of the fastening strips.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view of a resilient floor system according to the invention;

FIG. 2 is a perspective view of a sub-floor section constructed in accordance with the invention;

DESCRIPTION OF A PREFERRED EMBODIMENT

Figure 3:
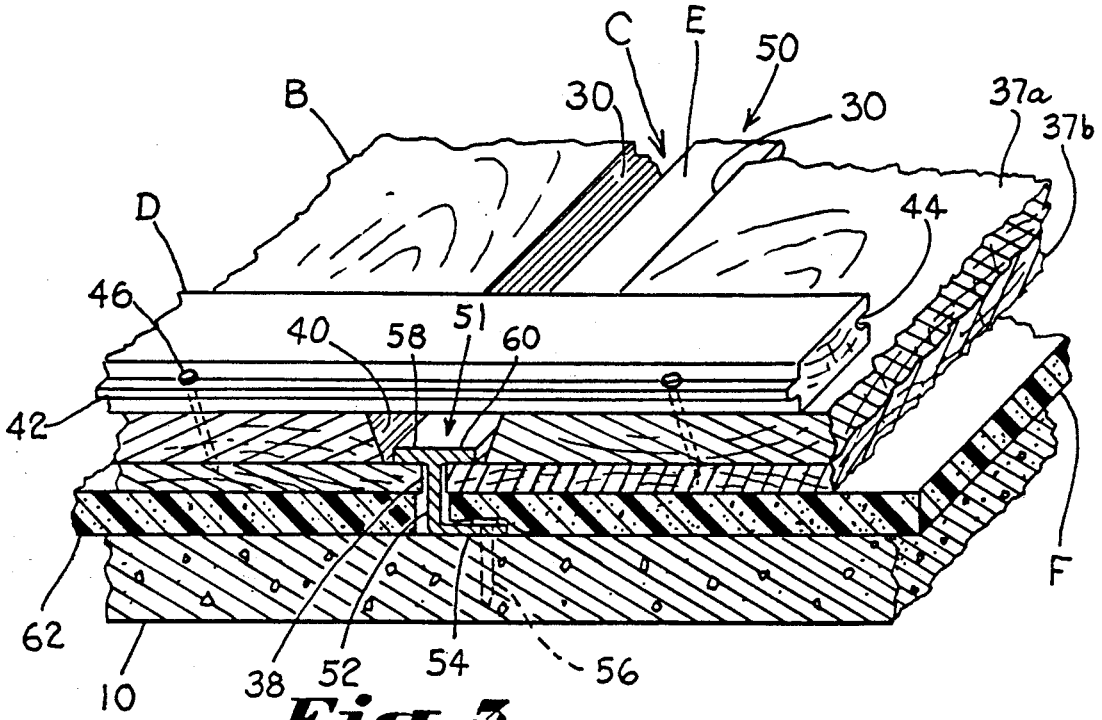
FIG. 3 is an enlarged sectional view of a joint of a resilient flooring system according to the invention.

Referring now in more detail to the drawings, a resilient flooring system, designated generally as A is disclosed which includes a plurality of sub-floor sections B carried above a base surface 10 to define a sub-floor 12. A slot means C is formed between adjacent floor sections. A plurality of flooring strips D extend transverse to the sub-floor sections to define a floor and attach to the sub-floor sections in an integral manner, such as by nailing. Fastening means E is disposed within slot means C for engaging the sub-floor sections to limit upward movement of the sub-floor sections while allowing downward movement of the sub-floor sections. Resilient means F in the form of a layer of resilient material co-extends generally underneath the sub-floor sections and resilient floor. The resilient means biases the sub-floor sections upwardly against the fastening means. In this manner, the floor and sub-floor are integral and move vertically together to provide resiliency against the resilient layer.

As can best be seen in FIG. 2, sub-floor sections B include elongated wood sections 20 which have a first edge 22 and a second edge 24. Each ledge includes a first upwardly extending side 26, an inwardly extending horizontal abutment ledge 28 and a second upwardly extending side 30. Second side 30 terminates at an upper nailing surface 32. First side 26 originates at a base 34. Sub-floor sections B, when arranged side-by-side as can best be seen in FIG. 3, co-extend generally underneath the entire floor 36 which is formed by flooring strips D attached to sub-floor. Preferably, each sub-floor section B includes a first sheet **37*a* of plywood, and a second sheet 37*b* of plywood, nailed or glued together. In this manner, the sub-floor sections may be constructed on site in an inexpensive manner. Second sheet 37*b* may have its edges beveled to provide second sides 30**. One-half inch plywood may be used.

Slot means C includes a narrow slot 38 defined between adjoining sub-floor sections B and a widened groove, designated generally as 40. As can best be seen in FIGS. 3 and 4, slot 38 is defined between first sides 26 of adjoining sub-floor sections and widened groove 40 is formed between second sides 30 of adjacent sub-floor sections. Second sides 30 taper outwardly.

Flooring strips D includes elongated, variable length flooring strips 40 which include a tongue 42 and a groove 44. The strips may be of standard dimension having a width of 2¼ inches and a length of from 1 foot to 8 feet. Sub-floor sections B preferably have a width of 16 inches and a length of 4 feet. The flooring strips D extend transverse to sub-floor sections B and bridge widened groove 40. Flooring strips D may be affixed to sub-floor sections B by nails 46 driven into nail surface 32 of sub-floor sections B. Fastening means E for securing sub-floor sections B to base surface 10 and for providing relative vertical movement of sub-floor sections preferably includes an elongated fastening strip which includes lateral flange means, designated generally as 50, for engaging sub-floor sections B to limit upward movement. In FIG. 3, the elongated fastening strip is provided by a fastening strip 51 having a vertical stem 52, a base flange 54 secured to base surface 10 by a nail 56, and first and second lateral flanges 58 and 60. Flanges 58 and 60 may extend alternately from stem 52 or may be continuous as shown. Lateral flanges 58 and 60 are abutted by abutment ledge 28 of adjacent sub-floor sections to limit the upward movement of the sub-floor sections. Interposed between the sub-floor sections and base surface 10 is resilient means F which urges sub-flooring sections against the flanges. Preferably, resilient means F is a layer 62 of resilient material, such as foam or rubber, depending on the application. Preferably, foam layer 62 extends underneath the sub-floor sections and abuts against stem 52. However, it is also contemplated that foam layer 62 be continuous and that base flange 54 sits a top and is fastened through foam layer 62. In either case, foam layer 62 is generally co-extensive with the surface area of base 34 of all sub-floor sections B underneath floor 36 so that a high degree of resiliency is provided.

Figure 4:
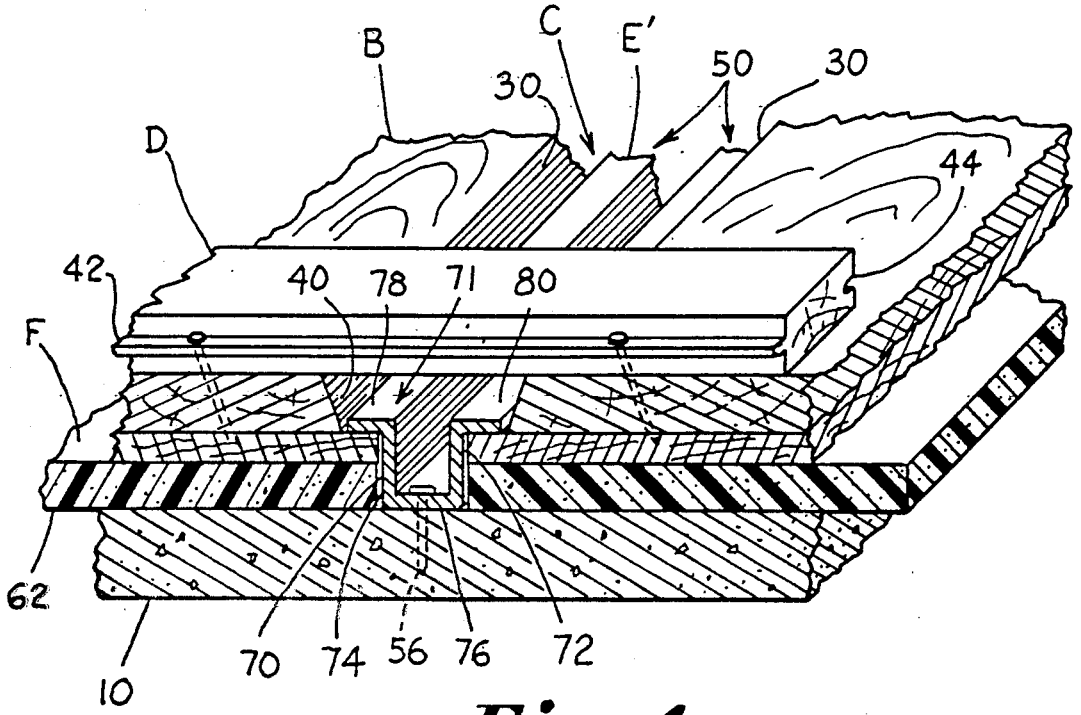
FIG. 4 is an alternate embodiment of a resilient joint for a resilient floor system according to the invention.

In FIG. 4, the elongated fastening strip is provided by a U-channel having a pair of vertical legs 70 and 72 disposed within slot 74 of slot means C. A base flange 76 is attached to base surface 10 either directly or through foam layer 62. In this case, lateral flange means 50 is provided by a first flange 78 and a second flange 80 extending horizontally from the vertical legs of the U-channel. Again, abutment ledge 28 of adjoining sub-floor sections B engages underneath the lateral flanges 78, 80 to limit upward movement and thus provide a means for limiting the upward movement.

As can best be seen in FIGS. 3 and 4, widened groove 40 (as defined by adjacent, second sides 30) tapers outwardly so that the lateral flanges of the fastening strips do not bind in the space, and the lateral flanges move freely, in a relative sense, in the space, as sub-floor sections B move up and down to provide resiliency to floor 36. Flooring strips D are integrally attached and move with sub-floor 12 provided by sub-floor sections B arranged generally co-extending underneath floor 36. Resilient layer 62 extends under generally the entire surface area of sub-floor 12 and exterior floor 36.

Thus, it can be seen that a resilient floor system can be had for exercising, athletics, and the like, in which an outer floor 36 is provided with a degree of resiliency as provided by a vertically moving sub-floor B which flexes on a resilient layer 62 as limited by fastening strips.

While a preferred embodiment of the invention has been described using specific terms, such description is for illustrative purposes only, and it is to be understood that changes and variations may be made without departing from the spirit or scope of the following claims.

What is claimed is:

1. A resilient flooring system for assembly on a base surface to provide a resilient floor comprising:

a plurality of sub-floor sections arranged generally co-extending with said floor in a side-by-side arrangement;

a resilient layer of a resilient material carried on said base surface underneath said sub-floor sections;

slot means defined between adjacent floor sections having an open top;

limit means carried in said slot means for limiting vertical movement of said sub-floor sections in an upward direction while permitting vertical movement in an opposite downward direction;

a plurality of flooring strips extending transverse to said sub-floor sections bridging said open top of said slot means, said flooring strips having an upper floor surface defining an exterior floor; and means for attaching said flooring strips to said sub-floor sections so that said exterior floor and sub-floor sections move unitarily as limited by said limit means.

2. The system of claim 1 wherein said sub-floor sections are elongated.

3. The system of claim 1 wherein each of said sub-floor sections have a first edge and a second edge opposite said first edge, and said first and second edges each include an upwardly extending first side terminating at an inwardly extending abutment ledge, and said abutment ledge terminates at an upwardly extending second side.

4. The system of claim 3 wherein said second side terminates at an upper surface of said sub-floor section and said first side originates at a base surface of said sub-floor section.

5. The system of claim 3 wherein said limit means is engaged by said abutment ledge to limit the upper movement of said flooring.

6. The system of claim 5 wherein said slot means comprises a widened groove defined between said abutment ledge and said flooring strips in which said limit means is disposed for relative movement.

7. The system of claim 6 wherein said limit means comprises horizontal flange means disposed within said widened groove which abuts said abutment ledges of said sub-floor sections.

8. The system of claim 1 wherein said slot means comprises a narrow slot defined between adjacent flooring sections, and a widened groove which is widened relative to said narrow slot, and said limit means being disposed in said widened groove for limiting upper movement of said sub-floor sections while permitting downward movement of said sub-floor sections.

9. A resilient flooring system for assembly on a base surface to provide a resilient floor comprising:

a plurality of sub-floor sections carried above said base surface to define a sub-floor;

slot means formed between adjacent sub-floor sections;

a plurality of flooring strips extending transverse to said sub-floor sections bridging said slot means to define a floor, and attachment means for attaching said flooring strips to said sub-floor sections so that said floor and sub-floor are integral and move vertically together;

stationary fastening means disposed within said slot means and affixed to said base surface for engaging said sub-floor sections in said slot means in such a manner to allow downward movement of said sub-floor sections while limiting upward movement of said sub-floor sections relative to said base surface; and resilient means carried between said base surface and said sub-floor sections biasing said sub-floor sections upwards against said fastening means so that said sub-floor sections and flooring strips move vertically and integrally relative to said stationary fastening means to provide a resilient floor.

10. The system of claim 9 wherein said fastening means includes a first interconnector for engaging a first sub-floor section on a first side of said fastening means, and said fastening means includes a second interconnector for engaging to a second sub-floor section on a second side of said fastening means.

11. The system of claim 9 wherein each of said sub-floor sections have a first edge and a second edge opposite said first edge, and said first and second edges each include an upwardly extending first side terminating at an inwardly extending abutment ledge, and said abutment ledge terminates at an upwardly extending second side.

12. The system of claim 11 wherein said slot means comprises a slot between said first sides of adjacent floor sections and a widened groove between second sides of adjacent flooring sections which is widened relative to said slot.

13. The system of claim 12 wherein said fastening means is disposed within said widened groove and abuts said abutment ledge.

14. The system of claim 12 wherein said fastening means includes a generally U-shaped channel strip having a pair of spaced vertical legs carried in said slot and first and second lateral flanges extending in opposite directions in said widened groove, and anchor means for anchoring said fastening strip to said base surface.

15. The system of claim 12 wherein said fastening means includes an elongated fastening strip having a vertical stem carried in said slot, first and second lateral flanges extending in opposite directions carried by said vertical stem in said widened groove, and anchor means for anchoring said fastening strip to said base surface.

16. The system of claim 9 wherein said slot means includes a slot defined between first sides of adjacent flooring sections, a widened groove defined between said second sides of adjacent sub-floor sections, and said fastening means is disposed within said widened groove for operatively limiting said movement.

17. The system of claim 16 wherein said widened groove tapers outwardly to reduce binding of said fastening means.

18. The system of claim 9 wherein said sub-floor co-extends under generally the entire area of said floor.

19. The system of claim 18 wherein said resilient means comprises a resilient layer of resilient material generally co-extending with said sub-floor.

20. The system of claim 9 including anchor means for anchoring said fastening strips to said base surface to eliminate floating and dead spots in said flooring system.

21. A resilient flooring system assembled on a base surface comprising:

a plurality of sub-floor sections carried above said base floor sections to define a sub-floor;

slot means defined between adjacent ones of said sub-floor sections;

an elongated fastening strip carried within said slot means secured to said base surface;

flooring strips extending transverse to said sub-floor sections defining a floor;

attachment means for attaching said flooring strips to said sub-floor sections so that said sub-floor and floor move integrally together in a vertical direction to provide resiliency;

resilient means urging said sub-floor sections against said fastening strips to limit the vertical upward movement of said floor and sub-floor attached together while permitting said floor and sub-floor to move downwardly against said resilient means to provide said resilient floor and said slot means includes a slot defined between first sides of adjacent flooring sections, and a widened groove defined between second sides of adjacent sub-floor sections.

22. The system of claim 21 wherein said fastening strips include generally U-shaped channel strips having a pair of spaced vertical legs carried in said slot means and first and second lateral flanges extending in opposite directions in said widened groove, and anchor means for anchoring said fastening strip to said base surface.

23. The system of claim 21 wherein said fastening strip includes a vertical stem carried in said slot, first and second lateral flanges extending in opposite directions carried by said vertical stem in said widened groove, and anchor means for anchoring said fastening strip to said base surface.

24. The system of claim 21 wherein said fastening strip comprises lateral flange means for engaging said sub-floor sections to limit the upward movement of said sub-floor sections.

25. The system of claim 24 wherein said sub-floor sections include abutment means for engaging said lateral flange means in said limiting position.

26. The system of claim 24 including a vertical connector which carries said flange means at an upper portion of said connector, and said vertical connector is connected to said base surface.

27. The system of claim 25 wherein said lateral flange means disposed in a groove formed between adjacent sub-floor sections.

28. The system of claim 28 wherein said groove is defined by tapering sides which taper outwardly and upwardly to reduce binding of said lateral flange means in said groove.

29. The system of claim 21 wherein said resilient means comprises a resilient layer of resilient material generally co-extending with said sub-floor.

30. The system of claim 21 wherein said sub-floor co-extends under generally the entire area of said floor.

31. The system of claim 30 wherein said resilient layer co-extends under generally the entire area of said floor.

32. The system of claim 3 wherein said sub-floor sections include a first planar section, and a second planar section affixed to said first planar section, and said second sides are defined by beveled edges of said second planar section.

* * * * *